US005492644A

United States Patent [19]

Minkin

[11] Patent Number: 5,492,644

[45] Date of Patent: Feb. 20, 1996

[54] CLEANING OBJECT WITH MESSAGE THEREON

[75] Inventor: Gary Minkin, Clayton, Mo.

[73] Assignee: The Mart Corporation, Maryland Heights, Mo.

[21] Appl. No.: 177,180

[22] Filed: Jan. 4, 1994

[51] Int. Cl.[6] ..... C11D 17/00

[52] U.S. Cl. ..... 252/134; 252/DIG. 16; 252/92

[58] Field of Search ..... 252/134, DIG. 16, 252/92

[56] References Cited

U.S. PATENT DOCUMENTS

| | | | |
|---|---|---|---|
| 246,989 | 9/1881 | Wilkerson | 248/686 |
| 488,393 | 12/1892 | Jewett | 401/19 |
| 680,052 | 8/1901 | Lynch | 248/686 |
| 1,416,962 | 5/1922 | Meeks | 401/8 |
| 1,636,709 | 7/1927 | Schmidt | 252/92 |
| 1,707,334 | 4/1929 | Unfried | 252/174 |
| 1,983,002 | 12/1934 | Reeves | 252/92 |
| 2,243,634 | 5/1941 | Kadish | 401/8 |
| 3,293,684 | 12/1966 | Tundermann | 15/605 |
| 3,341,457 | 9/1967 | Schmidt | 252/92 |
| 3,403,106 | 9/1968 | Story et al. | 252/92 |
| 3,413,230 | 11/1968 | Dupuis | 252/92 |
| 3,565,709 | 2/1971 | Grebe | 156/62.2 |
| 3,773,672 | 11/1973 | Bredice | 252/92 |
| 4,081,394 | 3/1978 | Bartley | 252/91 |
| 4,861,505 | 8/1989 | Farman | 252/92 |

FOREIGN PATENT DOCUMENTS

| | | | |
|---|---|---|---|
| 20768 | 9/1897 | United Kingdom | 252/92 |
| 2228492 | 8/1990 | United Kingdom | C11D 17/04 |

*Primary Examiner*—Paul Lieberman
*Assistant Examiner*—Patricia Hailey
*Attorney, Agent, or Firm*—Wood, Phillips, VanSanten, Clark & Mortimer

[57] ABSTRACT

An improved cleaning/treating object of the type having a body with an exposed surface defined by a releasable cleaning/treating agent such that the body size diminishes as the cleaning/treating agent is released. A tag is connected to the body and has a message thereof. The tag is defined by a material that is different than the cleaning/treating agent so that as the cleaning/treating agent on the body is expended, the tag remains sufficiently intact that the message thereon is still identifiable.

10 Claims, 2 Drawing Sheets

CLEANING OBJECT WITH MESSAGE THEREON

BACKGROUND OF THE INVENTION

1. Field of the Invention

This invention relates to cleaning objects, of the type having a releasable cleaning/treating agent and, more particularly, to a tag for use in association with the cleaning object to display a message after the cleaning/treating agent is expended.

2. Background Art

It is known to form cleaning/treating agents into a discrete mass, such as a bar. Certain body maps, waxes, polishes and the like are manufactured so that the cleaning/treating agent defines the entire mass. As the cleaning/treating agent is released, the size of the mass diminishes.

One example of such a structure is a conventional bar of soap. With the bar diminished in size to a relatively thin shape, the bar becomes brittle. The small bar is difficult to use and parts thereof often break off and may cause clogging of drains, as in sinks and showers. The thin bar is also prone to dissolving into a soft, shapeless mass.

Another problem with the conventional cleaning object of the type described above is that once expended, no identifying material remains as might be valuable to a consumer. Typically, a bar of soap will have impressed thereon a company name or trademark for the product. However, in a relatively short time period, the impressed information is worn away so that the only identifiable material remaining is the color of the releasable cleaning/treating agent. Since the outer wrapper is normally discarded before the first use, the consumer may be unable to identify a product that he/she considers worthy of re-purchase. The result of this may be a loss of return business to a supplier.

Various inserts and attachments have been devised throughout the years for use with cleaning objects, such as soap bars. In U.S. Pat. Nos. 1,707,334, to Unfried, and 3,773,672, to Bredice, inserts are shown embedded in a soap bar, primarily to maintain the integrity of the bar through its useful life.

In U.S. Pat. Nos. 680,052, to Lynch, and 246,989, to Wilkerson, external attachments are shown for a soap bar primarily to serve as a support for the soap bar to prevent disintegration thereof as when the soap sits in a pool of water.

None of the above patents addresses the problem of identifying the product or providing other useful information in association with the product after the exhaustion of part or all of the useable soap mass.

SUMMARY OF THE INVENTION

According to the invention, an improved cleaning/treating object is provided of the type having a body with an exposed surface defined by a releasable cleaning/treating agent such that the body size diminishes as the cleaning/treating agent is released. A tag is connected to the body and has a message thereof. The tag is defined by a material that is different than the cleaning/treating agent so that as the cleaning/treating agent on the body is expended, the tag remains sufficiently intact that the message thereon is still identifiable.

With the invention, the manufacturer or supplier of the cleaning/treating object can place a wide range of information on the tag. The information can be in the nature of an identification of the entity manufacturing or supplying the product or information relating to the quality of the cleaning/treating object or another product. The information could include instructions regarding use or might be a coupon for the same or another product. Other messages are also contemplated by the invention that might be valuable to the consumer and/or supplier.

The body may be made from a number of different materials, such as soap, wax, etc.

The tag may be partially or fully embedded in the cleaning/treating agent. Alternatively, the tag may be at least partially exposed as to define a handle or an area with the message thereon that is at all times visible during the useful life of the product.

The tag can be made from a number of different materials. Examples of such materials are metal, plastic, wood, paper, and the like.

The tag may be encased in a protective layer to preserve the message thereon.

The invention also contemplates a cleaning/treating object of the type having a body with an exposed surface defined by a releasable cleaning/treating agent such that the body size diminishes as the cleaning/treating agent is released. A tag having a message thereon is connected to the body with the tag being constructed to remain sufficiently intact that the message thereon is identifiable after the cleaning/treating agent defining the body is expended.

The tag could be made from the cleaning/treating agent and protected as by a coating or a protective sheath.

DETAILED DESCRIPTION OF THE DRAWINGS

Figure 1:
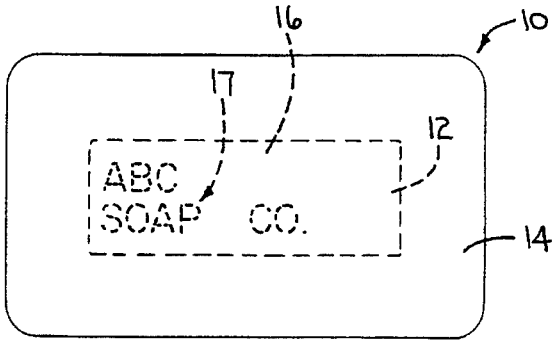
FIG. 1 is a plan view of a cleaning/treating object with a tag connected thereto according to the present invention.
Figure 2:
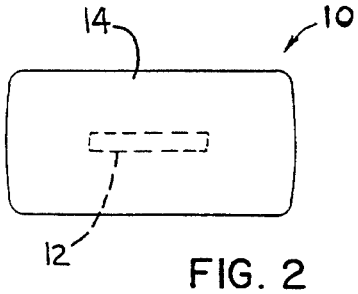
FIG. 2 is an end elevation view of the cleaning/treating object of FIG. 1.
Figure 3:
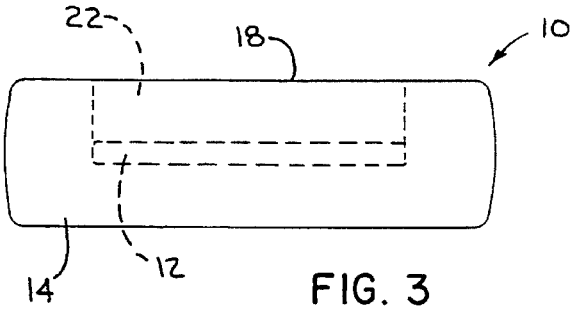
FIG. 3 is a side elevation view of the cleaning/treating object of FIGS. 1 and 2.

In FIGS. 1–3, a cleaning/treating object is shown at 10 with a tag 12, according to the present invention, connected thereto. The cleaning/treating object 10 has a body 14 defined by a solidified cleaning/treating agent. The shape of the body 14 is not critical to the present invention. It is known to make cleaning/treating objects in round shapes, oval shapes, etc. The cleaning/treating agent can be any of a number of different compositions. It could be soap, wax, an abrasive, or the like.

The tag 12 has a rectangular shape with at least one flat surface 16 thereof bearing a message 17. In this case, the message 17 is the identification of either the manufacturer or supplier of the object 10.

The tag 12 is fully embedded in the body 14 and is shown to have the same general shape as the body 14. However, it is not necessary that the tag 12 have a conforming shape. In this case, the tag 12 serves the dual purposes of reinforcing the body 14 and providing identifying material to the consumer with the cleaning/treating agent defining the body 14 exhausted.

More particularly, the cleaning/treating object 10 has an exposed surface 18 which is normally wetted and drawn against a surface to be cleaned/treated. As the cleaning/treating agent is released, the body 14 reduces in size. With the cleaning/treating agent fully expended, the tag 12 remains intact.

The tag 12 can be made from a number of different materials that will survive the environment in which the cleaning/treating agent is used. For example, the tag 12 can be made from metal, plastic, wood, paper, or other suitable material.

The message 17 can be applied to the tag 12 in a number of different manners. The message 17 might be engraved or printed on the tag 12. Other methods of applying the message 17 are within the scope of the invention.

The tag 12 can contain a wide range of information that is valuable to the consumer. For example, the tag 12 may contain identifying material with respect to the supplier, manufacturer, or nature of the object 10 or another product. The tag 12 can contain other information relating to purchase. For example, the tag 12 could serve as a coupon for purchase of the same or another product.

The tag 12 could contain information relating to the use of the object 10. In one variation, a transparent window at 22 can be defined in the body 14 to allow instructions or the like to be visible therethrough to the user throughout the useful life of the object 10.

Figure 4:
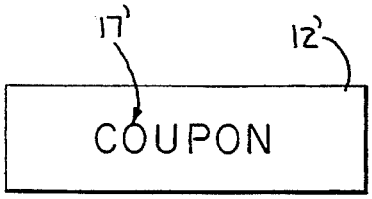
FIG. 4 is an isolated plan view of one type of tag according to the present invention.
Figure 5:
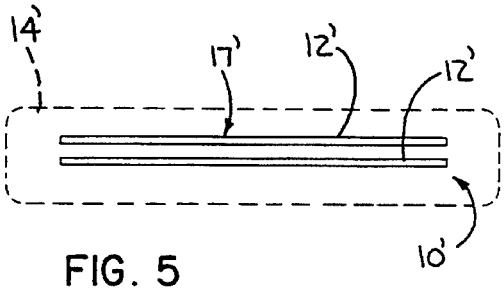
FIG. 5 is a side elevation view of a plurality of the tags embedded in a cleaning/treating object.

Multiple tags with messages 17' thereon can also be embedded fully or partially in the body. In FIGS. 4 and 5, the tags 12' are shown embedded in a body 14'. The tags 12' can be embedded in spaced relationship so that they are exposed and releasable at different times during the useful life of the object 10'.

Figure 6:
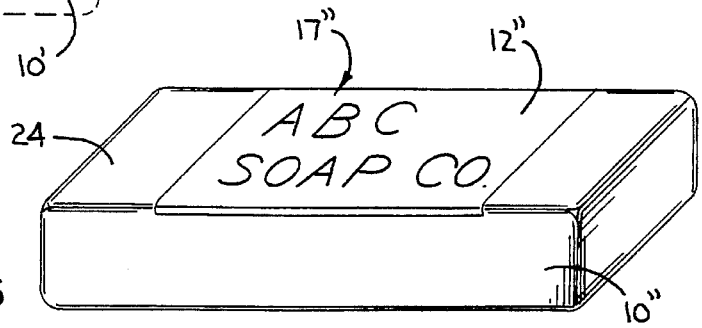
FIG. 6 is a perspective view of a cleaning/treating object with a modified form of tag, according to the present invention, incorporated therein.

In FIG. 6, a further modified form of tag 12" is shown. The tag 12" is embedded in one wall 24 of a cleaning/treating object 10". With this arrangement, the message 17" remains at all times exposed and visible to the user.

Figure 7:
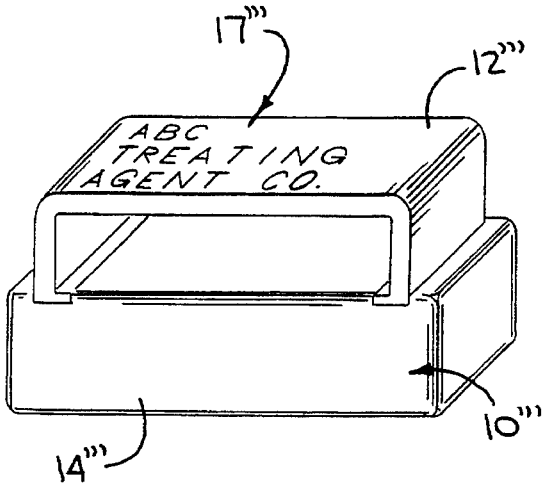
FIG. 7 is a perspective view of a cleaning/treating object with a tag, according to the present invention, serving as a handle for the cleaning/treating object.

In FIG. 7, a further modification, according to the invention, is shown. In FIG. 7, a tag 12''' is shown attached to a body 14''' and defines a handle which can be grasped by the user to facilitate transportation,use, and storage of the object 10'''. The identifying message 17''' remains at all times visible through the useful life of the object 10'''.

Figure 8:
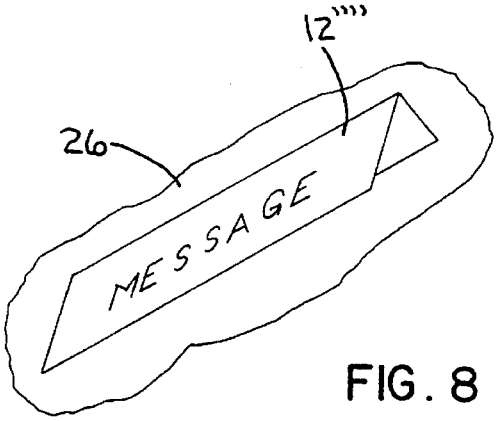
FIG. 8 is a perspective view of a tag, according to the present invention, encased in a protective material.

In FIG. 8, a further modified form of tag 12'''' is shown. The tag 12''''is a folded over sheet of paper which is contained within a protective sheath 26. The sheath 26 may be made of plastic or paper that is impervious to water. The tag 12'''' within the sheath 26 can be partially or fully embedded in an object 10, 10', 10", 10'''. With this arrangement, the tag 12'''' can be made as from paper, typed upon, and protected by the sheath 26. Once the body 14, 14', 14", 14''' is diminished in size sufficiently to expose the tag 12'''', the sheath 26 can be separated from the body 14, 14', 14", 14''' and opened to expose the tag 12''''.

Figure 9:
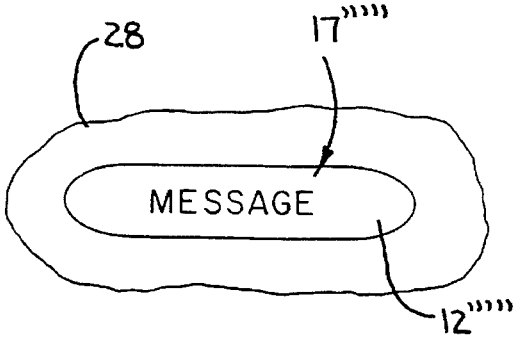
FIG. 9 is a plan view of another form of tag, according to the present invention, encased in a protective material.

A further modified form of tag 12''''' is shown in FIG. 9. The tag 12''''' is itself made from an expendable cleaning/treating agent, which can be the same as or different than the cleaning/treating agent in which the tag 12''''' is partially or fully embedded. A protective sheath 28 seals the tag 12''''' from water or other liquid as may cause it to dissolve. The tag 12''''' with the surrounding sheath 28 can be embedded partially or fully in the body 14, 14', 14", 14'''. Once the body 14, 14', 14", 14''' is diminished to the point that the tag 12''''' is visible, the tag 12''''' can be pealed away and the sheath 28 opened to view the message 17''''' thereon. Once the user has viewed the message 17''''', the tag 12''''' can be exhausted in the same manner as the body 14, 14', 14", 14''''' within which it is embedded.

With the inventive structure, the manufacturer and/or supplier of an expendable cleaning/treating object can provide to the consumer a wide range of valuable information concerning the product, the manufacture/supplier, the use of the product, repurchase of the product, etc. At the same time, the tag 12, 12", 12", 12''', 12'''' and 12''''' serves to reinforce the body 14, 14', 14", 14''' in use.

The foregoing disclosure of specific embodiments is intended to be illustrative of the broad concepts comprehended by the invention.

I claim:

1. In a cleaning/treating object having a body with an exposed surface defined by a releasable cleaning/treating agent such that the body size diminishes from an original size as the cleaning/treating agent is released, the improvement comprising:

a tag having a written message with wording thereon that is at least one of a) an identification of an entity, b) information regarding a quality of the cleaning/treating object, c) information regarding purchase of a product, and d) information regarding use of a product; and means for connecting the tag to the body so that the tag is fully embedded in the releasable cleaning/treating agent to be fully surrounded by the releasable cleaning/treating agent so that the tag is obscured by the releasable cleaning/treating agent with the body having its original size, said tag being defined by a material that is different than that of the cleaning/treating agent so that as the cleaning/treating agent on the body is expended, the tag remains sufficiently intact that the message thereof is still identifiable.

2. The improved cleaning/treating object according to claim 1 wherein the body comprises a bar of soap.

3. The improved cleaning/treating object according to claim 1 wherein the connecting means comprises the cleaning/treating agent on the body in which the tag is embedded.

4. The improved cleaning/treating object according to claim 1 wherein the tag is made at least partially from at least one of metal, plastic, wood, and paper.

5. The improved cleaning/treating object according to claim 1 wherein the tag is encased in a protective layer.

6. In a cleaning/treating object having a body with an exposed surface defined by a releasable cleaning/treating agent such that the body size diminishes from an original size as the cleaning/treating agent is released, the improvement comprising:

a tag having a written message thereon that is at least one of a) an identification of an entity, b) information regarding a quality of the cleaning/treating object, c) information regarding purchase of a product, and d) information regarding use of a product; and means for connecting the tag to the body so that the tag is substantially fully embedded in the releasable cleaning/treating agent so as to be fully surrounded by the releasable cleaning/treating agent so that the tag is obscured by the releasable cleaning/treating agent with the body having its original size, said tag being constructed to remain sufficiently intact that the message thereon is identifiable after the cleaning/treating agent defining the body is expended.

7. The improved cleaning/treating object according to claim 6 wherein the body comprises a bar of soap.

8. The improved cleaning/treating object according to claim 6 wherein the connecting means comprises the cleaning/treating agent on the body in which the tag is embedded.

9. The improved cleaning/treating object according to claim 6 wherein the tag is made at least partially from at least one of metal, plastic, wood, and paper.

10. The improved cleaning/treating object according to claim 6 wherein the tag is encased in a protective layer.

* * * * *